United States Patent [19]

Stern et al.

[11] 4,178,763

[45] Dec. 18, 1979

[54] SYSTEM FOR MINIMIZING VALVE THROTTLING LOSSES IN A STEAM TURBINE POWER PLANT

[75] Inventors: Louis P. Stern, Wadsworth, Ohio; Steven J. Johnson, McCandless Township, Allegheny County, Pa.

[73] Assignee: Westinghouse Electric Corp., Pittsburgh, Pa.

[21] Appl. No.: 889,770

[22] Filed: Mar. 24, 1978

[51] Int. Cl.[2] ..... F01K 13/02

[52] U.S. Cl. ..... 60/667; 60/660

[58] Field of Search ..... 60/660, 664, 665, 667; 290/40 R, 40 B, 40 C; 415/17, 36, 38

[56] References Cited

U.S. PATENT DOCUMENTS

| | | | |
|---|---|---|---|
| 3,286,466 | 11/1966 | Stevens | 60/646 |
| 3,802,189 | 4/1974 | Jenkins, Jr. | 60/665 |
| 3,896,623 | 1/1975 | Daniels | 60/665 |

*Primary Examiner*—Allen M. Ostrager
*Attorney, Agent, or Firm*—W. E. Zitelli

[57] ABSTRACT

A system which integrates the controls of a steam turbine power plant for minimizing power plant energy losses substantially caused by steam flow valve throttling is disclosed. The steam turbine power plant includes boiler pressure controls for controlling the boiler throttle pressure of a steam producing boiler and turbine-generator controls for positioning a plurality of turbine steam admission values to regulate the steam flow conducted through a steam turbine which governs the electrical energy generated by an electrical generator at a desired power generation level. The turbine-generator controls predetermines a plurality of valve position states to establish a predetermined valve grouping sequential positioning pattern for the steam admission valves to regulate steam flow through the steam turbine across the range of power generation, each predetermined state substantially corresponding to a minimum of valve throttling losses. The steam admission valves may be positioned at a present valve position state, which is other than one of the predetermined states, as a result of a change in desired power generation level. The disclosed system responds to this condition by governing the boiler pressure controls to adjust the boiler throttle pressure at a desired rate and in a direction to cause steam admission valves to be repositioned according to the sequential positioning pattern to a selected one of the predetermined efficient valve position states. The repositioning of the steam admission valves is performed by maintaining the generated energy substantially at the new desired power generation level.

18 Claims, 10 Drawing Figures

FIG.2
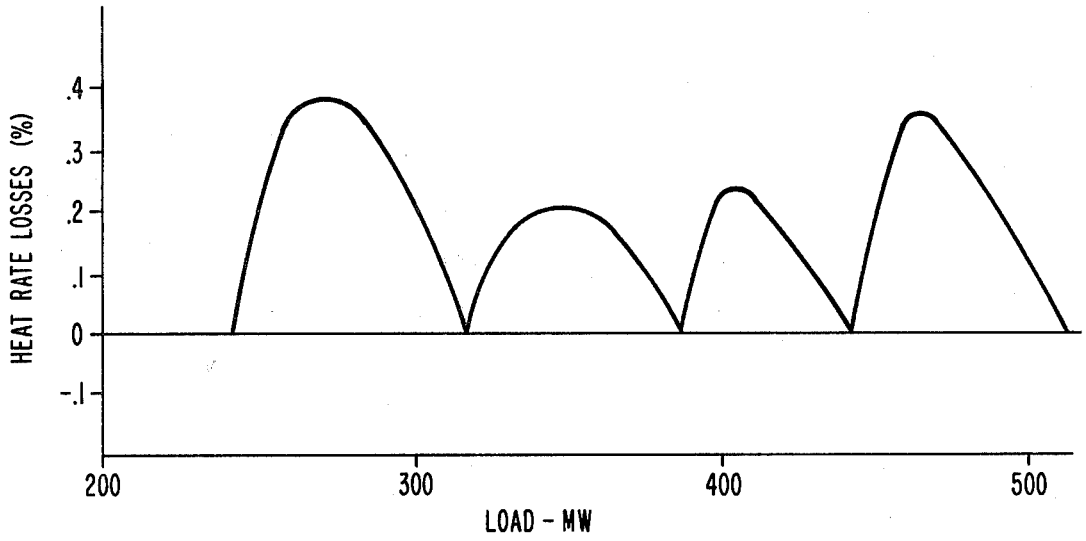
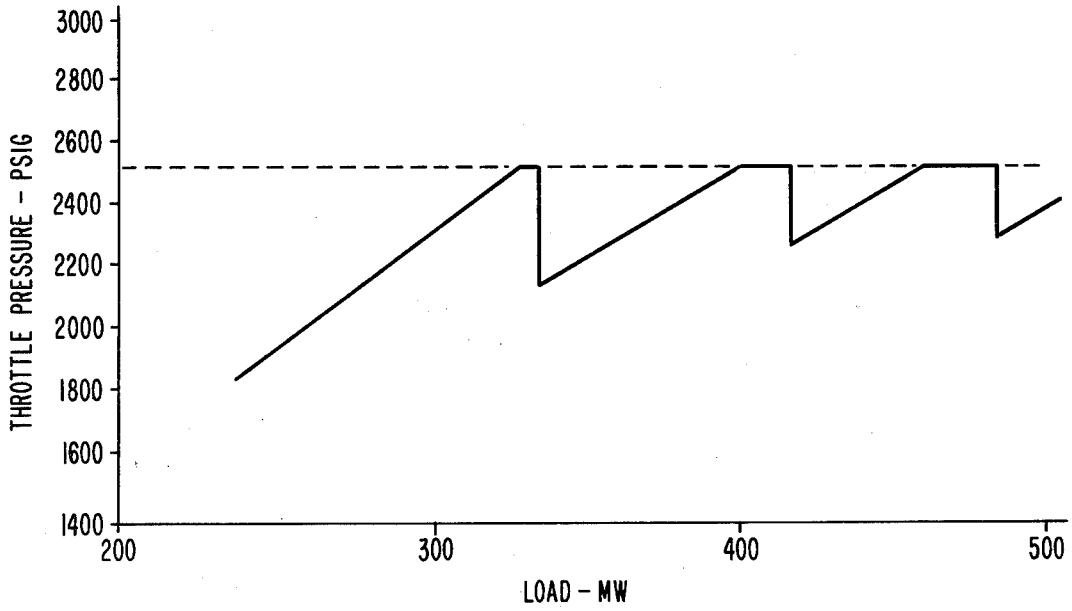
FIG.3

SYSTEM FOR MINIMIZING VALVE THROTTLING LOSSES IN A STEAM TURBINE POWER PLANT

CROSS-REFERENCE TO RELATED APPLICATIONS

Ser. No. 889,764, entitled "Efficient Valve Point Controller For Use In A Steam Turbine Power Plant", filed by M. H. Binstock and S. J. Johnson concurrently herewith and assigned to the present assignee.

Ser. No. 628,629, entitled "Optimum Sequential Valve Position Indication System For Turbine Power Plant", filed by L. B. Podolsky, C. L. Groves, Jr., and S. J. Johnson on Nov. 4, 1975, assigned to the present assignee and presently copending herewith, said application being incorporated by reference herein for the purposes of providing in greater detail a system for determining valve position states corresponding to minimizing valve throttling losses.

BACKGROUND OF THE INVENTION

The present invention relates to the field of boiler-turbine integrally controlled operations, and more particularly to a system which coordinates the control of the boiler and turbine systems of a power plant for governing the regulation of boiler throttle pressure to render the steam turbine admission valves in a selected one of a plurality of predetermined sequential valve position ranges which correspond to valve operating points effecting minimum throttling losses.

It has been known for some time that the efficiency of a steam turbine power plant is degraded by the throttling losses that occur during the time when the steam admission valves of the steam turbine are governing steam flow in the partially opened state. It is understood that any improvement in efficiency of plant performance by reduction of these throttling losses will substantially reduce fuel consumption and provide a significant economic savings in the process of energy production. Various methods, such as (1) constant throttle pressure-sequential valve operation; (2) throttling control-single valve operation; (3) sliding pressure; and (4) bypassing, have been utilized by some of the utilities to effect a reduction in valve throttling losses. For a more detailed description of these methods and how they compare to each other, refer to the paper entitled "A Review of Sliding Throttle Pressure For Fossil Fueled Steam-Turbine Generators" authored by G. S. Silvestri et al. which was presented at the American Power Conference, Apr. 18–20, 1972. Conclusions of this paper indicate that "hybrid" type turbine designs which combine sequential valve and sliding throttle pressure operation, particularly the 50% admission "hybrid" units, have been shown to offer more efficient performance characteristics overall. The word "hybrid" was used in the Silvestri paper to describe boiler-turbine units that utilize constant throttle pressure-sequential valve operation down to some valve point, say 50% admission, at which time the valve position (admission arc) is held constant and the throttle pressure is reduced to attain lower flows. The Silvestri paper did not consider any method other than the "hybrid" method to further increase plant efficiency.

A similar "hybrid" type boiler-turbine plant operation has also been disclosed in U.S. Pat. No. 3,262,431 issued to F. J. Hanzalek on July 26, 1966. The Hanzalek patent is directed to an operation of sliding boiler pressure and sequential valve operation utilizing a particular boiler control configuration. It appears that Hanzalek's operation pertains to sliding boiler pressure during turbine start-up and initial loading to a value where optimum temperature and pressure conditions exist in the boiler and thereafter, increases in turbine steam flow are controlled by normal sequential valve movement at constant boiler pressure until another optimum boiler condition point is desired. In neither, the paper by Silvestri et al. nor the U.S. Pat. No. 3,262,431, is there described or even suggested any control system or method of improving plant efficiency by reducing throttling losses during the sequential valve mode steam flow governing operation periods.

Recently, improvements have been directed towards sequential valve control operation of turbine power plants by calculating a set of sequential valve position ranges which relate to minimizing throttling losses and providing an indication to the power plant operators when the steam admission valves have been sequentially positioned in one of these ranges. For a more detailed description reference is made to the copending application Ser. No. 628,629, referenced hereinabove. This improvement, of course, allows the power plant operator to select steam turbine operational points which correspond to minimizing throttling losses and provide a more efficient plant operation. On the other hand, this improvement normally consists of about 5 or 6 sequential valve position ranges of which each constitutes only approximately 3% or less of the steam flow; therefore, it is understood that the majority of sequential valve positioning is conducted at operational points which do not offer this minimizing effect with regard to throttling losses.

While there is a general awareness of the poor response with respect to operating turbine steam admission valves wide open and regulating boiler throttle pressure to govern load which is more commonly referred to as "sliding pressure" plant operation, some control system designers have continued to pursue this sliding pressure mode of operation by providing further improvement to the response thereof. One such control system is described in U.S. Pat. No. 3,802,189 issued Apr. 9, 1974 to T. W. Jenkins, Jr. Jenkins' system appears to provide a single point desired set point for a turbine control valve at a value preferably corresponding to a valve position near wide open. A rapid response to any increase in power generation demand is achieved by controlling the turbine control valve away from its steady state desired set point setting to a new position closer to wide open by a conventional turbine governor. As the actual valve position deviates from the desired set point value, the boiler throttle pressure set point is adjusted as a function of the position deviation to increase the boiler throttle pressure causing the power generation to increase beyond that demanded. Concurrently, the conventional turbine governor repositions the control valve until conditions exist which satisfy the requirements of the power generation being that demanded and the valve position being at the desired set point value. It appears that Jenkins' system controls power generation by sliding pressure in a boiler follow mode of operation permitting a faster response to power generation demand deviations as compared to a turbine follow mode of operation. However, it is understood that in order to achieve this improvement in response, Jenkins must relinquish some efficiency by steady state positioning the control valve away from a wide open position such that the turbine governor may be capable of responding quickly to power generation demand increases by modulating the control valve temporarily closer to a wide open position until the boiler throttle pressure can be readjusted. Thus, in Jenkins' system, it is believed that the control valve is inefficiently positioned during the majority of plant operation.

From the foregoing discussion, it appears that further improvements to boiler-turbine load control operations may be achieved in the areas of minimizing the throttling losses of the steam admission valves over a greater portion of the governing load range while at the same time maintaining an acceptable responsiveness of the steam turbine governor to changes in power generation demand.

SUMMARY OF THE INVENTION

In accordance with the broad principles of the present invention, a system integrates the controls of a steam turbine power plant for minimizing power plant energy losses substantially caused by steam flow valve throttling. The steam turbine power plant which generates electrical energy at a desired power generation level includes a steam producing boiler having a boiler throttle pressure associated therewith, a steam turbine having a plurality of steam admission valves for regulating the amount of boiler produced steam conducted therethrough, and an electrical generator driven by the steam turbine to generate electrical energy. While maintaining the power plant at the desired power generation level, the system renders the valve positions of said plurality of steam admission valves to a selected state of a plurality of predetermined steam admission valve position states by adjusting the value of the boiler throttle pressure as a function of the selected state, each predetermined state substantially corresponding to a minimum of valve throttling losses. More specifically, first and second predetermined valve position states are segregated from the plurality of predetermined states as determined by their relationship to a present valve position state which is other than one of the predetermined states. Subsequently, first and second virtual steam flow values are calculated respectively corresponding to the segregated first and second predetermined states. Accordingly, one of the first and second predetermined states is selected based on a relationship between the correspondingly calculated first and second virtual steam flow values and a present value of steam flow corresponding to the desired power generation level. The one predetermined state becomes the selected state if the boiler throttle pressure adjustment required to render the plurality of steam admission valves to the one predetermined state is within predetermined boiler throttle pressure limitations; otherwise, the other of the first and second predetermined states becomes the selected state. In either case, the boiler throttle pressure is adjusted in a direction and at a desired rate to cause the plurality of steam admission valves to be positioned from their present valve position state to the selected steam admission valve position state. In essence, the system is operative to cause regulation of steam flow at any desired power generation level with a selected one of the predetermined valve position state substantially effecting a minimum of valve throttling losses.

BRIEF DESCRIPTION OF THE DRAWINGS

FIG. 2 is a graph exemplifying heat rate losses with respect to power generation level (MW) substantially resulting from valve throttling losses in accordance with a predetermined valve grouping sequential positioning pattern of the steam admission valves;

FIG. 3 is a graph illustrating a typical boiler throttle pressure adjustment profile with respect to power generation level as determined by a plurality of predetermined valve position states;

DESCRIPTION OF PREFERRED EMBODIMENTS

Figure 1:
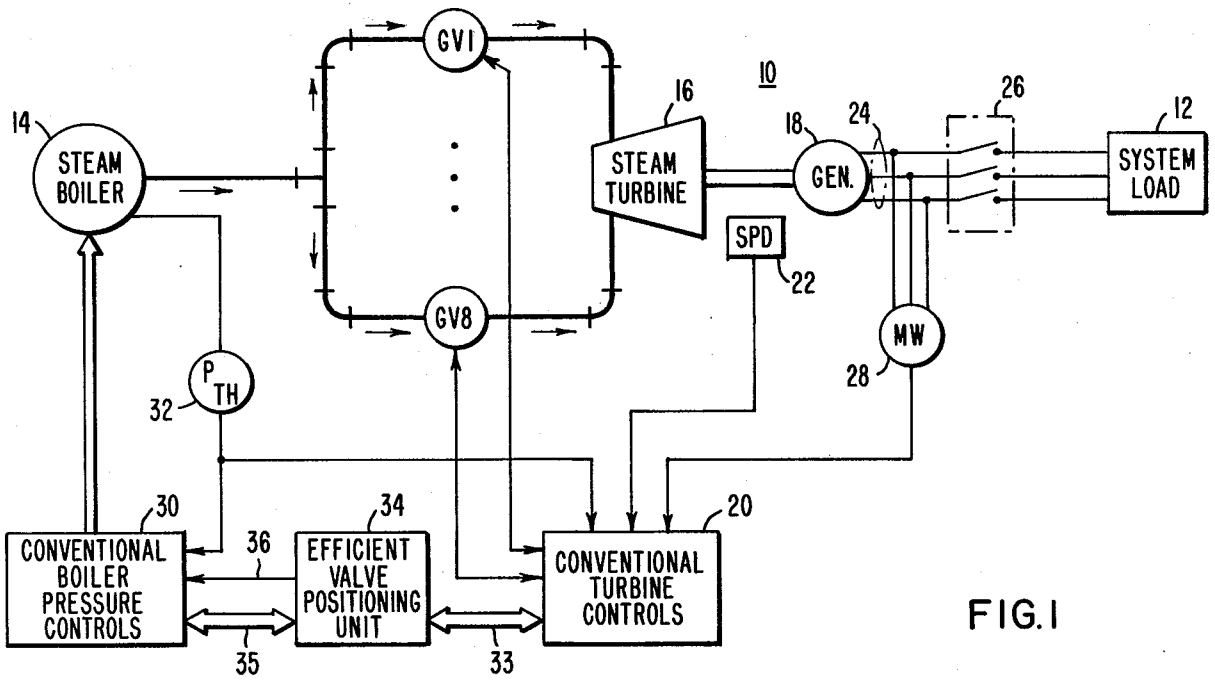
FIG. 1 is a block diagram schematic of a steam turbine power plant suitable for embodying the broad principles of the present invention.

The environment in which the principles of the invention are preferably embodied may be described in connection with a steam turbine power plant 10, such as that shown in FIG. 1, which produces electrical energy at some desired power level to a system load 12. As part of the operation of the power plant 10, a conventional steam boiler system 14 provides steam at some regulated boiler throttle pressure, $P_{TH}$, to a conventional steam turbine system 16 which is mechanically coupled to drive an electrical generator 18. The amount of steam conducted through the steam turbine system 16 is, at times, controlled by a plurality of governor valves GV1, . . . ,GV8 which may be disposed in any number of conventional arrangements so as to permit either single valve or sequential valve arc admission operation. In the normal operation of the power plant 10, a conventional turbine controller 20 positions the plurality of governor valves GV1, . . . ,GV8 for the purposes of admitting steam to the turbine 16 to increase the speed of the turbine 16 from turning gear to a speed which is synchronous to the system load 12, utilizing an actual speed measurement signal provided to the turbine controller 20 from a standard speed transducer 22. The governor valves GV1, . . . ,GV8 are generally modulated to establish a state of synchronization between the generated electrical signal over power lines 24 and the electrical system load 12.

At synchronization, a set of main breakers 26 are closed to connect the output of the generator 18 with the system load 12 utilizing the power lines 24. Thereafter, the turbine controller 20 governs the electrical power generation of the generator 18 by positioning the plurality of governor valves GV1, . . . ,GV8 preferably in accordance with a function of a desired power generation value and a signal representative of the actual power generation level as measured from electrical power lines 24 and provided to the turbine controller by a conventional megawatt transducer 28. It is preferred for the purposes of this embodiment that the positioning of the governor valves GV1, . . . ,GV8 be transferred to a sequential valve mode operation beyond a predetermined desired power generation level, say 37% for example, in order to reduce throttling losses resulting from the single valve mode of operation wherein all of the steam admission values may be positioned partially opened. Concurrent to the turbine speed and load control as described hereabove, the boiler throttle pressure $P_{TH}$ is controlled in either a boiler follow mode or a coordinated plant control mode by a conventional boiler pressure controller 30. A measurement of the pressure $P_{TH}$ is provided to both controllers 20 and 30 from a typical pressure transducer 32 and is utilized thereby for purposes of trim correction and feedback control which will be described in greater detail hereinbelow.

While conventional load governing operation in the sequential valve mode offers a reduction in throttling losses over that of single valve mode operation, there still remains room for further reduction to minimize the throttling losses during the periods of load governing operation when each of the segregated value groups of the sequential valve pattern are exclusively operated in the partially opened position. A typical example of the heat rate losses which may occur during a sequential valve pattern is shown in the graph of FIG. 2 for a 490 MW turbine-generator (2400 VSIG/1000° F./1000° F./2.5 in Hg) having 8 control valves and 5 sequential value points specified at 37.5%, 50%, 62.5%, 75% and 100% of load reference. For a better understanding of the details of operating a power plant such as that denoted by 10 as shown in FIG. 1 in a sequential valve mode reference is made to the U.S. Pat. No. 3,878,401 issued Apr. 15, 1975 to Uri G. Ronnen. In the broadest aspect of the preferred embodiment as shown in FIG. 1, an efficient valve positioning unit 34 is coupled to both the turbine and boiler pressure controllers 20 and 30, respectively and is functionally operative to substantially reduce the typical heat rate losses generally associated with sequential valve mode of operation.

According to one embodiment, the unit 34 may communicate with the turbine controller 20 over signal lines 33 to access therefrom information pertaining to a set of predetermined sequential valve position ranges which have been determined to provide a minimum of throttling losses in the conventional load governing operation in the sequential valve mode. These valve position ranges may be similar to the optimum sequential valve position ranges determined by the system described in the copending application, Ser. No. 628,629, referenced to hereinabove. In addition, both the boiler pressure controller 30 and turbine controller 20 provide the efficient valve positioning unit 34 with their present operational status over signal lines 35 and 33, respectively.

In accordance with this operational status, the efficient valve positioning unit 34 selects one of a plurality of predetermined sequential valve position ranges in which it desires the sequential valve position to operate within and proceeds to adjust a boiler throttle pressure set point 36 which governs the boiler throttle pressure control within the boiler pressure controller 30 to render the control valves GV1, . . . ,GV8 positioned within the selected predetermined sequential valve position range. This process which is functionally provided by unit 34 may be repeated for each desired power generation operating point asserted by either the power plant operator locally or the automatic dispatching system remotely. An example of a resulting boiler throttle pressure profile with respect to load reference is shown in the graph of FIG. 3. The turbine system used for plotting FIG. 3 is similar in capacity and operating conditions as that used for illustration in FIG. 2, and therefore, it is proposed that the heat rate losses shown in FIG. 2 as one example may be substantially eliminated through the operation of the effective valve positioning unit 34 in coordinating the control of both the boiler and turbine controllers 30 and 20, respectively. A more detailed description of the efficient valve positioning unit 34 is provided hereinbelow.

In some installations, the conventional turbine controls 20 of the embodiment described in connection with FIG. 1 may comprise a digital electro-hydraulic (DEH) turbine control system for governing the load of the turbine power plant in a sequential valve mode. The operation of the DEH system includes the execution of a number of task oriented subroutines in accordance with a real time priority structure within a programmed digital computer to monitor the status of the turbine and boiler systems 16 and 14, respectively, and control the turbine system 16 as a function of the monitored status. Accordingly, it was found suitable for this embodiment to incorporate the efficient valve positioning function 34 (see FIG. 1) in a programmed digital computer similar to the typical DEH as a programmed subroutine being executed in coordination with other essential subroutines as directed by the real time operating system of a DEH type controller. A simplified functional block diagram of a DEH type turbine controller 20 is depicted in FIG. 4 interfacing with the turbine control valves GV1, . . . ,GV8, the boiler system 14 and boiler controls 30 using conventional digital-to-analog (D/A) and analog-to-digital (A/D) input/output (I/O) units.

Figure 4:
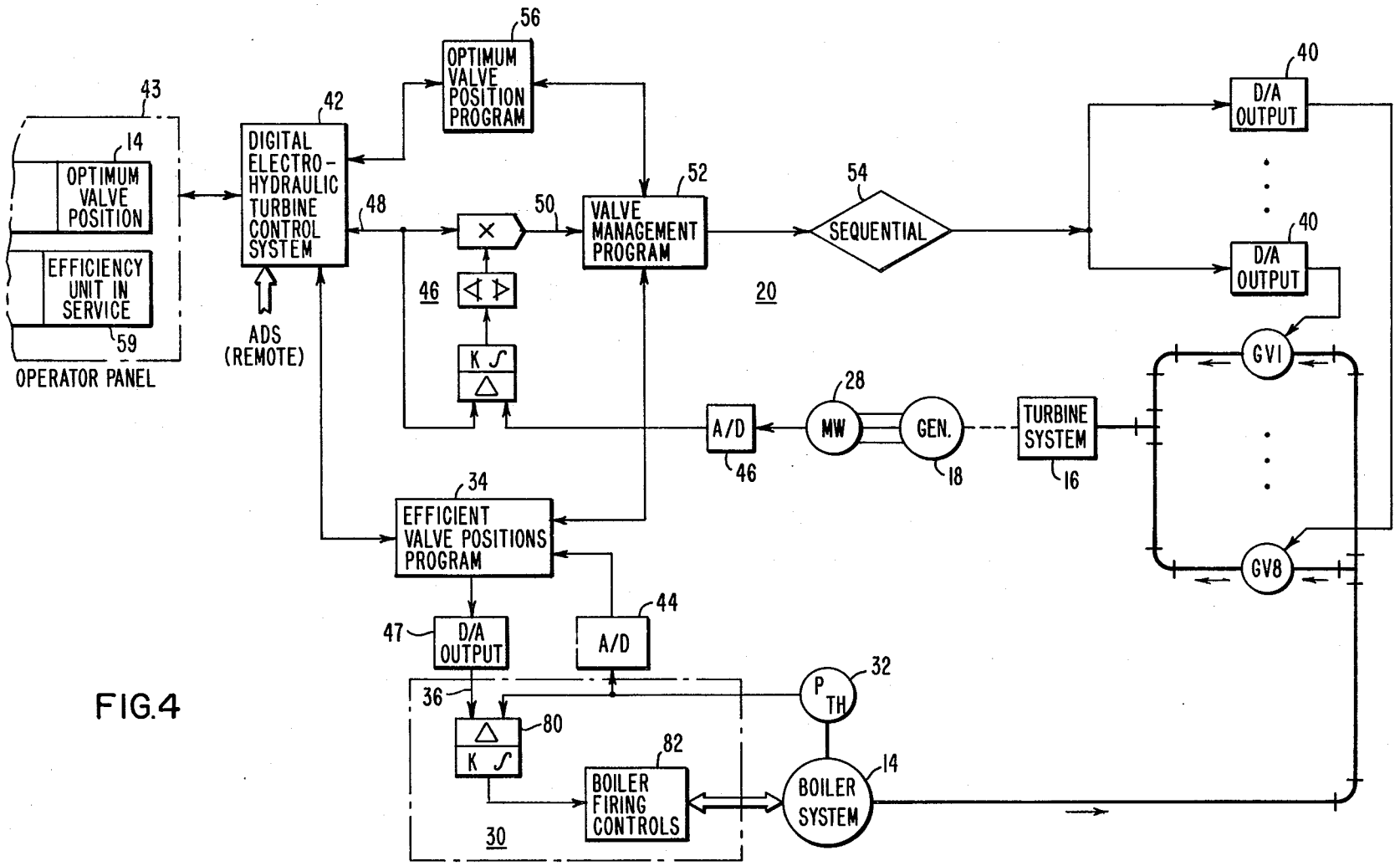
FIG. 4 is a block diagram schematic of a programmed digital computer embodiment suitable for use in the power plant of FIG. 1.

Referring to FIG. 4, the plurality of governor valves GV1 through GV8 are controlled by an analog signal, which is applied from its associated digital-to-analog output device referred to at 40. A digital electrohydraulic turbine control system of the type described in U.S. Pat. No. 3,878,401 is referred to generally at 42. Briefly, however, the system 42 in its preferred form includes a programmed digital computer with a conventional analog input system such as that referred to at 44 and 46 to interface the system analog signals such as $P_{TH}$ and MW, respectively, with the computer at its input. Computer output signals are interfaced with external control devices such as the control valves GV1, . . . ,GV8 and the boiler pressure controller 30 utilizing the digital-to-analog output devices 40 and 47 respectively. The system 42 also includes a conventional interrupt system to signal the computer when a computer input is to be executed, or when a computer output has been executed. An operator panel such as 43 provides for operator control, monitoring, testing and maintenance functions of the turbine generator system. Signals from the panel 43 are applied to the computer through the contact closure input system; and computer display outputs are applied to the panel 43 through the contact closure and direct digital output systems. The input signals are applied to the computer from various relay contacts in the turbine generator system through the contact closure input system. In addition, the digital electrohydraulic control system 42 not only receives signals from electric power, steam pressure, and speed detectors, but also from steam valve position detectors and other miscellaneous detectors which are interfaced with the computer (see FIG. 1). The contact closure outputs from the computer of the system 42 operate various system contacts, a data logger such as an electric typewriter, and various displays, lights and other devices associated with the operator panel 43.

The program system for the computer is preferably organized to operate the control system 42 as a sample data system in providing turbine and plant monitoring and continuous turbine and plant control. The program system also includes a standard executive or monitor program to provide scheduling control over the running of programs in the computer as well as control over the flow of computer inputs and outputs through the previously mentioned input/output systems. Generally, each program is assigned to a task level in a priority system, and bids are processed to run the bidding program with the highest priority. Interrupts may bid programs, and all interrupts are processed with the priority higher than any task level. A more detailed explanation of the program system as well as the digital electrohydraulic turbine control system is disclosed in U.S. Pat. No. 3,878,401, issued Apr. 15, 1975, entitled "System and Method For Operating a Turbine Powered Electrical Generating Plant In A Sequential Mode", which patent is incorporated herein by reference for a more detailed understanding thereof.

This system functions in general such that, when an operator panel signal is generated, external circuitry decodes the panel input, and an interrupt is generated to cause a panel interrupt program to place a bid for the execution of a panel program which provides a response to the panel request. The panel program can itself carry out the necessary response or it can place a bid for a logic task program to perform the response; or it can bid a visual display program to carry out the response. In turn, any of the above-mentioned programs may operate the contact closure outputs to produce the responsive panel display, such as the display for optimum valve position referred to at 56. Periodic programs are scheduled by an auxiliary synchronizer program which in turn is bid periodically by the executive program. An analog scan program is bid periodically to select analog inputs for updating through an executive analog input handler. After scanning, the analog scan program converts the inputs to engineering units, performs limit checks and makes certain logical decisions.

The system 42 generally includes a control program, a portion of which being referred to at 46, which functions to compute the positions of the control valves GV1, . . . ,GV8 to satisfy load demands during operator or remote automatic operation (ADS) and tracking valve position during manual operation. Generally, the control program shown as 46 is organized as a series of relatively short subprograms which are sequentially executed.

A load reference 48 is generated at a controlled or selected rate within the system 42 to meet the defined load demand. The control function denoted at 46 provides for positioning the control valves GV1, . . . GV8 so as to satisfy the existing load reference with substantially optimum dynamic and steady-state response. The load reference value computed by the operating mode selection function, for example, is compensated for frequency participation by a proportional feedback trim factor (not shown) and for megawatt error by a second feedback trim factor shown at 46. The frequency and megawatt corrected load reference operates as a flow demand 50 for a valve management program 52. The output 50 of the speed and megawatt corrected load reference, functions as a governor valve set point which is converted into a percent flow prior to application to the valve management program 52.

With the utilization of the valve management system as described in the U.S. Pat. No. 3,878,401, which is incorporated by reference herein, the governor valve control function provides for holding the governor valves closed during a turbine trip, holding the governor valves wide open during start-up and under throttle valve control (not shown), driving the governor valves closed during transfer from throttle to governor valve operation during start-up, reopening the governor valves under position control after brief closure during throttle/governor valve transfer and thereafter during subsequent load control.

During automatic computer control, the valve management program 52 develops the governor valve position demands needed to satisfy steam flow demand and ultimately the load reference; and do so in either the sequential or the single valve mode of governor valve operation or during transfer between these modes. Since changes in boiler throttle pressure $P_{TH}$ can cause actual steam flow changes in any given turbine inlet valve position, the governor valve position demands may be corrected as a function of boiler throttle pressure $P_{TH}$ variation. Governor valve position is calculated from a linearizing characterization in the form of a curve of valve position (or lift) versus steam flow. A curve valid for rated pressure operation is stored for use by the valve management program 52, and the curve employed for control calculations is attained by correcting the stored curve for changes in load or flow demand, and preferably for changes in actual throttle pressure. Another stored curve of flow coefficient versus steam flow demand is used to determine the applicable flow coefficient to be used in correcting the stored low-load position demand curve for load or flow changes. Preferably, the valve position demand curve is also corrected for the number of nozzles downstream from each governor valve. A more detailed explanation of such valve position versus steam flow, and flow coefficient curve is provided in U.S. Pat. No. 3,878,401.

In the sequential valve mode, which is represented by block 54 of FIG. 4, the governor valve sequence is used, in determining from the corrected position demand 50, which governor valve or group or governor valves is fully open, and which governor valve or group of governor valves is to be placed under position control to meet load reference changes. Position demands are determined for the individual governor valves; and individual sequential valve analog voltages 40 are generated to correspond to the calculated valve position demands.

Figure 5:
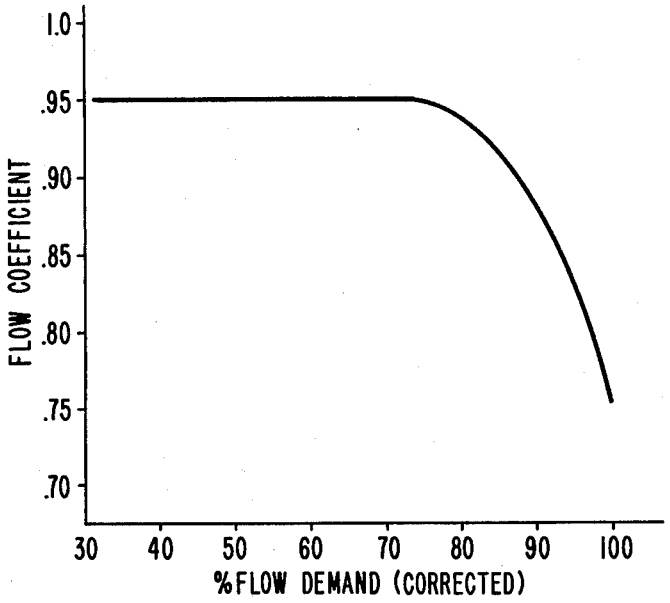
FIG. 5 is a graph illustrating the flow coefficient for various percentages of flow utilized in the programmed digital computer embodiment of FIG. 4.

Referring to FIG. 5, data representing flow coefficients is contained in the computer memory of the control system 42 based on the flow demand 50 computed by the digital electrohydraulic control system. The flow demand value is shown on the abscissa of the curve and the flow coefficient is calculated along the ordinate. The flow coefficient is the ratio of actual flow at a flow demand over the theoretical flow if the orifice coefficient were equal to one. Once the ordinate for a particular flow demand is calculated by use of the data in the computer memory, the stage flow coefficient is calculated, which is used to calculate the curve of FIG. 6.

Figure 6:
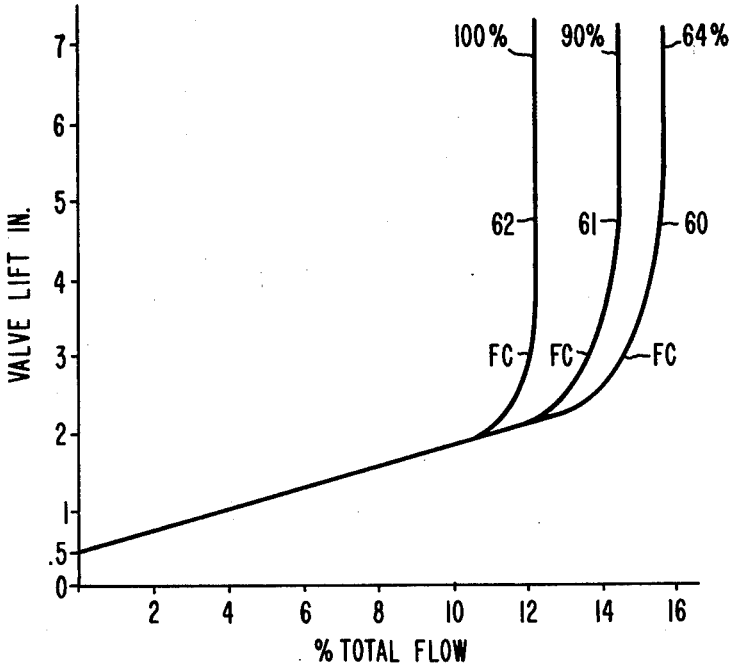
FIG. 6 is a graph illustrating valve lift as a function of steam flow for various total steam flow requirements utilized in the programmed digital computer embodiment of FIG. 4.

In FIG. 6, the flow demand for each valve is represented as a percentage of total flow on the abscissa; and the lift of the steam inlet or governor valve is shown on the ordinate, whereby the lift of the valve for a predetermined flow demand can be calculated. A curve 60 represents a dynamic characterization of operation of a control or governor valve from its closed position to its fully open position to pass its proportionate share at approximately 64% of total steam flow. The corrected stage flow coefficient for critical flow (see FIG. 5) is essentially equal to one for the typical installation described where flow demands are less than 64% of total flow. The exact transition point may vary between 60 and 70%, for example, from installation to installation depending upon the design of the governor valve. If the total flow demand is greater than that having a corrected flow coefficient of one, a different curve, such as that referred to at 61 for a total steam flow of 90%; and another curve referred to at 62 for a 100% total steam flow demand is calculated. Each curve, such as 60, 61 or 62, is composed preferably of five linear segments in order to facilitate ease of calculation and economy of memory space in the computer. The curves are calculated by multiplying the abscissa and the ordinate of each of the curves by the stage flow coefficient of FIG. 5. The curves such as 60, 61, and 62 may be either calculated by the computer in accordance with the total steam flow demand or there may be a plurality of such curves stored in the computer with the appropriate curve being selected for particular steam flows. The curves of 60, 61, and 62 may also be modified dynamically for variations in the throttle pressure and also for variations in the number of nozzles under each valve, as described in the referenced U.S. Pat. No. 3,878,401. For each of the curves an FC flow point is calculated, above which a very high associated gain is required in order to maintain and linearize any action of the actuator for the control valve. Between such FC point and the fully opened position only approximately five to ten percent of the flow for that valve is controlled. Between such FC point and the fully closed position, the efficiency of the plant is reduced because of steam losses due to throttling. In calculating the FC point, the maximum steam flow that the valve is capable of admitting is calculated in accordance with the total steam flow demand. A predetermined percentage of such maximum flow, such as 92%, for example, is the FC point.

The DEH control system 42 additionally includes a system 56 for indicating an optimum set of sequential valve position ranges during the sequential valve operating mode of the turbine power plant for the purposes of determining valve position settings offering minimum throttling losses. The system 56 operates by checking each of the steam inlet or governor valves GV1, . . . ,GV8 in the sequence in which such valves are controlled to admit varying levels of steam flow to the turbine. In determining the fully open and fully closed positions for each of the valves, the system 56 utilizes the position demand 50 plus in some cases in a small tolerance or deadband. In determining the position of the valve intermediate the fully open or fully closed position, the system 56 utilizes the flow demand for each valve Q which is calculated in accordance with a valve lift versus steam flow curve (see FIG. 6). This is compared with a calculated electrical representation of an FC point for each valve, which point represents a percentage of maximum flow adjacent the end of the linear range of the valve prior to the valve going into the so-called high slope region of relatively unstable control. The FC point is calculated in accordance with a percentage GCl of the maximum possible flow of the valve. The maximum possible flow for each such valve is determined in accordance with the steam flow versus valve lift curve (see FIG. 6). The FC point also has a tolerance or deadband.

Each time the system 56 operates, it first effectively eliminates all flags which would indicate that the valves were in an optimum position. Then the system checks the operating mode to determine that the system is operating in the sequential valve mode. It then checks for each valve, as to whether or not the valve is within a fully opened deadband range; and if such is the case, the "valve open" flag is set and the program goes to the next valve in the sequence. If it is not fully opened, the system then checks to determine if the steam flow demand for the valve is greater than the calculated FC point. If such is the case, the program 56 exists and starts from the beginning to check the complete sequence of valves. If the flow demand is not greater than the FC point, the system then checks to determine if the valve is within an FC point deadband range. If such is the case, the "valve open" flag is set and the system goes on to check the next valve. If the valve is not in such range, the system then checks to determine whether or not the valve is in a fully closed position within the deadband range associated therewith. If such is the case, the program then checks to determine if the "valve open" flag has been set by a previous valve; then the system continues with checking the next valve in the sequence. However, if the valve is neither in the closed position or the "valve open" flag has not been set, then the program exits. Thus, each time a valve is determined not to be in one of the optimum positions, the program starts over again and eliminates all indications that any of the valves were in such optimum position. For a more detailed description of a typical optimum valve position system functioning in a DEH turbine control system reference is made to the copending application Ser. No. 628,629, which is incorporated by reference herein.

The efficient valve positioning system 34, as indicated above in accordance with a DEH control system embodiment is implemented as a program subroutine within the DEH controller 42. The system 34 functions to coordinate the activities of the control program 46, the valve management program 52 and the optimum valve position program 56 with the boiler pressure controller 30 to provide an integrated mode of control therebetween. Under normal operation, the valve management program 52 provides information to the positioning system 34 in the form of a throttle pressure correction factor, valve flow characteristics and flow demand, for example. In addition, the optimum valve position detection system 52 may provide to the positioning system 34 conditions relating to the optimum valve position status. Certain plant status such as single/sequential valve mode status, megawatt controller status and load change in progress status are also made available to the positioning system 34 as a result of the normal periodic execution of the logic program within the DEH system 42. To effect an in service condition of the positioning system 34, a pushbutton 59 located on the control panel 43 may be depressed. The status of the pushbutton 59 is detected by the DEH system 42, utilizing the standard panel interface and associated program supplied therewith, and is additionally made available to the positioning system 34.

Figure 7:
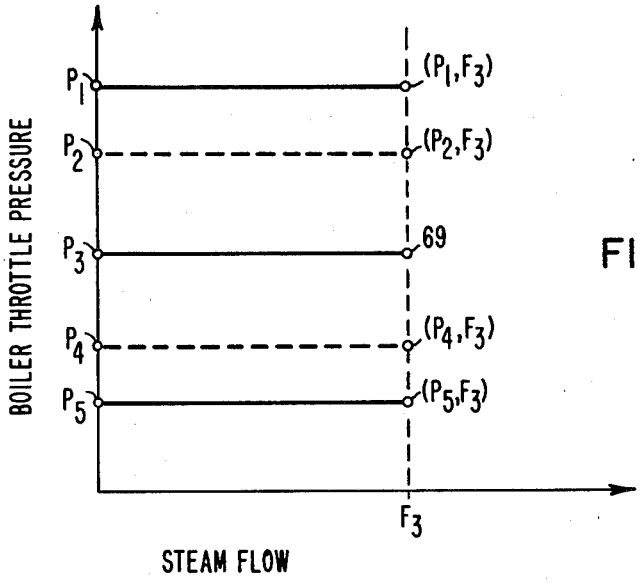
FIG. 7 is a graph relating boiler throttle pressure adjustment to a steam flow corresponding to the desired power generation level.
Figure 8:
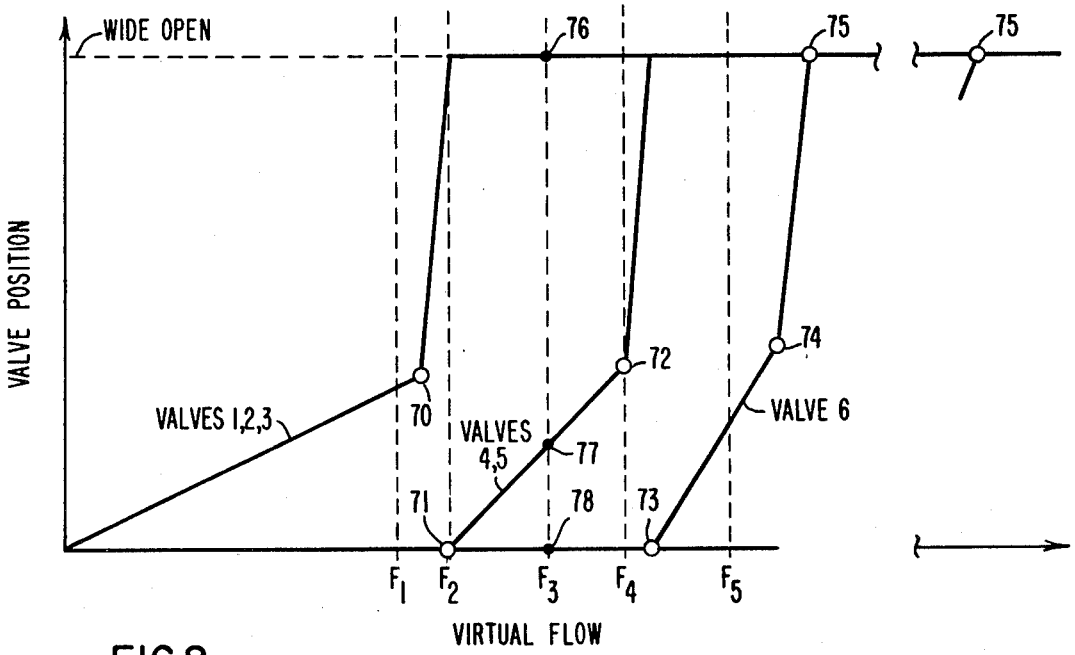
FIG. 8 is a simplified graphical illustration of a typical predetermined valve grouping sequential positioning pattern based on a plurality of predetermined valve positioned states suitable for use in the embodiment of FIG. 4.

The structure and operation of the efficient valve positioning system 34 may sufficiently be described by assuming a typical initial operating state of the steam turbine plant 10 which illustrates the sequential positions of the groupings of the control valves GV1, . . . ,GV8 as a result of a recently enacted desired load change. Referring to the graph of FIG. 7, the point denoted by 69 indicates the initial operating state of the turbine wherein the steam flow is denoted by $F_3$ and the boiler throttle pressure is denoted by $P_3$. Because the control unit 46 (see FIG. 4) remains operative during the functioning of the efficient valve positioning system 34, the control valves are positioned to keep steam flow substantially constant during any change in boiler throttle pressure. For this example then, the operation of the power plant 10 is maintained substantially along the vertical line of the graph of FIG. 7 which intersects the abscissa at a steam flow $F_3$. Therefore, any adjustment to boiler throttle pressure results in a new plant operating point along the vertical line denoted by the fixed steam flow $F_3$. Referring to the graph of FIG. 8, a set of valve groups are presented in a predetermined sequential valve position opening pattern exemplifying the calculations performed by the valve management program 52 as described hereinabove. The encircled portions 70 through 75 of the graph are exemplary of a set of sequential optimum valve position ranges which may be predetermined from the operation of the optimum valve positioning detector 56. It is understood from the description provided above, that when all of the valves are positioned in one of these predetermined ranges, a state of minimum throttling losses is anticipated. In the present assumed operating state ($P_3$, $F_3$), the corresponding sequential valve positions are fixed by the interaction of flow line $F_3$ with the predetermined sequential valve position opening pattern and are denoted by the points 76, 77 and 78 wherein control valves GV1, GV2 and GV3 are wide open; GV4 and GV5 are partially opened at 77; and GV6, GV7 and GV8 are fully closed. The present valve positions at 76, 77 and 78 are not in a predetermined optimum valve position range. The closest optimum valve position ranges appear to be the encircled ranges at 71 and 72.

It is one purpose then of the efficient valve positioning system 34 to cause the valves to be repositioned in a selected one of the optimum valve position ranges by adjusting the boiler throttle pressure set point which is output from the DEH system 42 through the interface unit 40 over line 36 to a conventional steam pressure set point controller 80 located in the boiler control system 30 (see FIG. 4). In turn, the controller 80 adjusts a conventional boiler firing control unit 82 to alter the conditions of the boiler 14 to cause the actual boiler throttle pressure $P_{TH}$ as measured by the transducer 32 to converge to the adjusted value of the boiler throttle pressure set point 36. Consequently, any change in boiler throttle pressure affects the electrical power output of the plant which is reflected to the load controller 46 of the DEH system 42 via megawatt transducer 28 and A/D interface 46 (see FIG. 4). Accordingly, the control valves GV1, . . . ,GV8 are governed to maintain a fixed load by the control unit 46. Control unit 46 repositions the control valves according to the sequential valve patterns of the valve management program 52 until the efficient valve positioning unit 34 terminates its adjustment of the boiler throttle pressure set point 36 as a result of detecting that the sequential valve positioning pattern is in one of the optimum valve position ranges.

Figure 9:
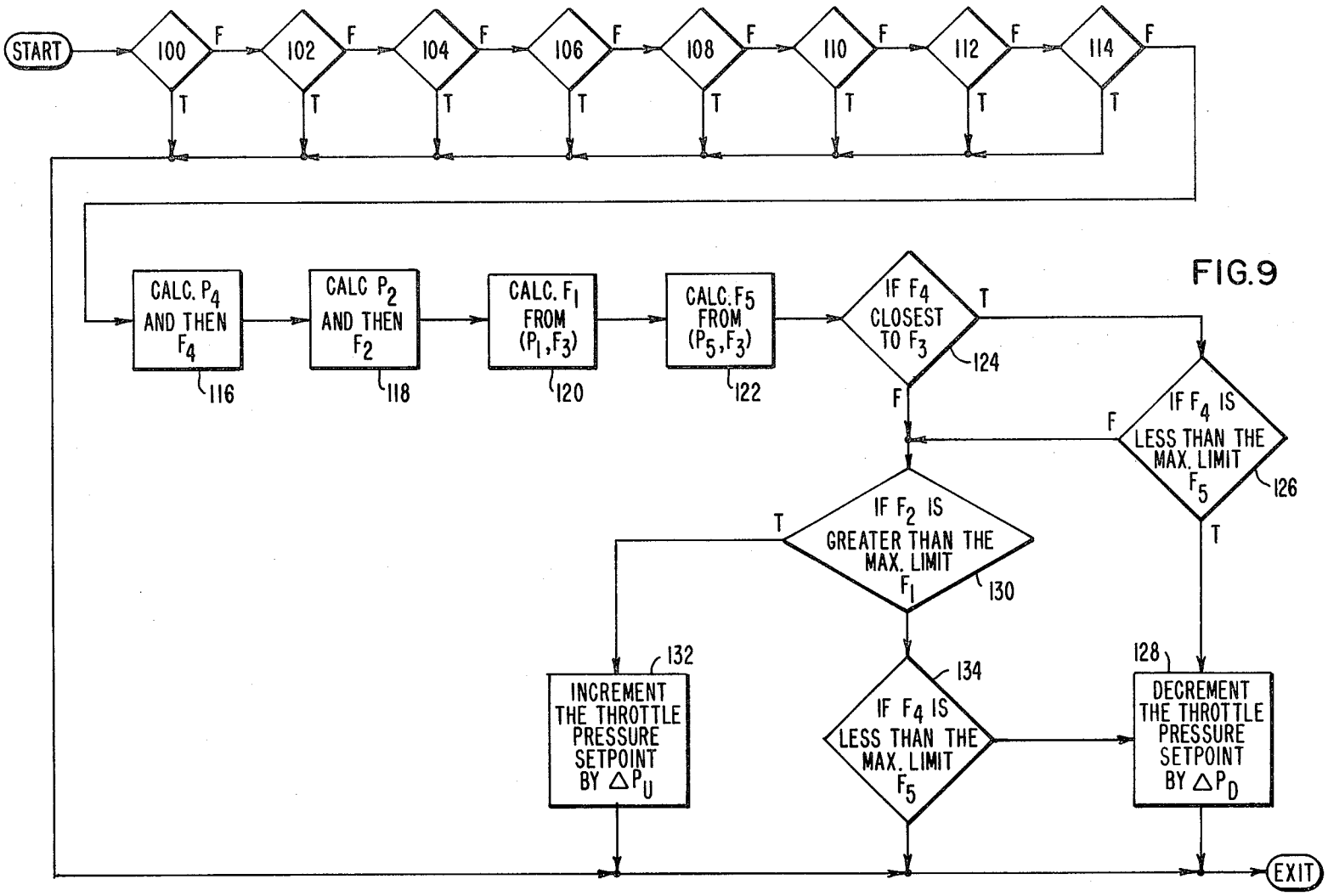
FIG. 9 is a flow chart characterizing the operation of a programmed digital computer according to one embodiment of the invention.

For a more detailed understanding of the efficient valve positioning program 34, a flowchart pertaining to its sequential execution of operations is shown in FIG. 9. The flowchart of FIG. 9 will be described below in conjunction with the graphs of FIGS. 7 and 8 using the exemplary initial plant operating state ($P_3$, $F_3$). Referring to the flowchart of FIG. 9, the efficient valve positioning program 34 begins with a plurality of logical decision making blocks 100, 102, . . . ,112, 114 to determine if a set of valid permissives for proper operation are satisfied. These conditions include, in respective correspondence to the decision block 100, 102, . . . ,114, the following:

(a) an optimum valve position condition;
(b) not in sequential valve mode;
(c) efficient valve positioning system not in service;
(d) megawatt controller not in service;
(e) $P_{TH}$ correction in service;
(f) load change in progress; and
(g) present actual throttle pressure value-set point value exceeds limit.

If the status of any of the aforementioned conditions are logically true indicating that an invalid condition exists, the efficient valve positioning program 34 may be prohibited from being executed during the present execution period. On the other hand, if the status of all the aforementioned conditions are logically false indicating that a permissive state exists, then program execution is permitted to continue at block 116.

The calculations to select one of the optimum valve position ranges, which may be at 71 or 72 (see FIG. 8) for the above described example, begins at block 116. Block 116 in cooperation with the valve management program 52 calculates a virtual flow value $F_4$ corresponding to the optimum valve position range which offers a greater virtual flow than the present flow demand, which is for the case at hand at 72. For this calculation, the valve management program 52 may be requested to determine the throttle pressure $P_4$ (see FIG. 7) based on the valve position settings of range 72 and the actual steam flow $F_3$. Once $P_4$ is determined, the pressure correction portion of the valve managenent program 52 may be performed using the ratio of the pressure value $P_4$ and a predetermined value of rated throttle pressure to calculate a new flow demand value which is used as the virtual flow value $F_4$. In the next block 118, the valve management program 52 is similarly requested to first calculate the pressure value $P_2$ corresponding to the optimum valve position range which offers a lower virtual flow than the present flow demand, which is for the case at hand at 71, and then calculate the virtual flow $F_2$ using the operating point ($P_2$, $F_3$) in its processing of pressure correction.

Before continuing, it should be explained that the adjustment of the boiler throttle pressure set point is limited by upper and lower pressure set point values, $P_1$ and $P_5$, respectively, which may be conventionally entered into the DEH system 42 through the control panel 42 (see FIG. 4). The values $P_1$ and $P_5$ are made available to the efficient valve positioning program 34 from the DEH system memory upon request. Thus, in the next program execution block 120, the minimum virtual flow $F_1$ is calculated using the pressure correction portion of the valve management program 52 based on the upper limit operating point ($P_1$, $F_3$). The following block 122 results in the calculation of maximum virtual flow $F_5$ with similar use of the valve management program 52 given the lower limit operating point ($P_5$, $F_3$).

Equipped with the complement of virtual flow values $F_1$, $F_2$, $F_4$, $F_5$, the program execution continues at block 124 to begin the selection of one of the optimum valve position ranges. In block 124, it is decided which of the virtual flow values $F_2$ or $F_4$ is closer to the present flow value $F_3$. If $F_4$ is closest to $F_3$, execution continues at block 126 where it is decided whether $F_4$ is greater or less than the maximum limit flow value $F_5$. If $F_4$ is less than $F_5$, block 128 decrements the throttle pressure set point valve by a predetermined amount $\Delta P_D$. The rate at which the throttle pressure is decreased is generally dependent on the frequency at which the program 34 is executed and the predetermined amount $\Delta P_D$. In the execution of blocks 124, 126 and 128; the program 34 has selected optimum range 72 and with each program execution decrements the boiler throttle pressure set point to affect the throttle pressure through the boiler controls 30 to cause the load controller 46 to react and position the valves within the optimum valve position range 72, for example. The program continues executing blocks 124, 126 and 128 to decrease the boiler throttle set point at the desired rate until the valve positions are within the range at 72. This condition, detected at the initial block of programming at 100, terminates the execution of program 34 by the DEH system 42 preventing any further decrease in set point 36 until the next desired load change is performed which will displace the valves outside an optimum valve position range.

In the event that either the value of $F_4$ is found to be greater than the maximum limit value $F_5$, which is an unallowable and invalid state, or the value of $F_2$ is closest to the present flow value $F_3$ as detected by blocks 126 or 124, respectively, the program execution continues at block 130 wherein it is determined whether $F_2$ is greater or less in value than the minimum limit $F_1$. If $F_2$ is greater in value than $F_1$, the program 34 increments the throttle pressure set point by another predetermined amount $\Delta P_u$ using block 132. The increase rate of the throttle pressure set point is set by the value selected for $\Delta P_u$ and the frequency of execution of block 132. In the execution of blocks 124, 130 and 132, the program 34 has selected optimum valve position range 71, for example, and with each program execution increments the boiler throttle pressure set point at the desired rate to similarly cause the valves to be positioned within the optimum valve range 71. This condition is detected at block 100 to direct program execution to bypass further adjustment of throttle pressure set point which will remain at its last incremented value until another desired load change is performed which causes the valve positions to be displaced outside of an optimum valve position range.

In the event that the value of $F_2$ is found to be closest to the present flow value $F_3$ (124), but the value of $F_2$ is further found to be less than the minimum flow value $F_1$, which is also an unallowable and invalid state (130), then the program execution continues at block 134 wherein it is determined whether $F_4$ is less than or greater than the maximum limit flow value of $F_5$. If $F_4$ is less than $F_5$, then the throttle pressure set point will be similarly decreased at the desired rate to bring the valves into the optimum range 72. Otherwise, the program 34 is exited and the pressure set point remains unchanged.

It is understood that the exemplary initial operating point ($P_3$, $F_3$) chosen to describe the embodiment shown in FIGS. 4 through 9 may be any practical value within the operating limitations of the power plant 10 which may exist after a desired load change and that the efficient valve positioning unit 34 will operate automatically as described hereinabove to select one of the predetermined optimum value position ranges which offer a minimization to throttling losses and adjust the throttle pressure set point to render a sequential valve position setting within the selected optimum valve position range. It is further understood that the flowcharts of FIG. 9 are provided in the present specification merely to illustrate one way in which the efficient valve positioning system 34 may be programmed in a DEH system embodiment and should not be considered as limiting to the scope of applicant's invention.

Figure 10:
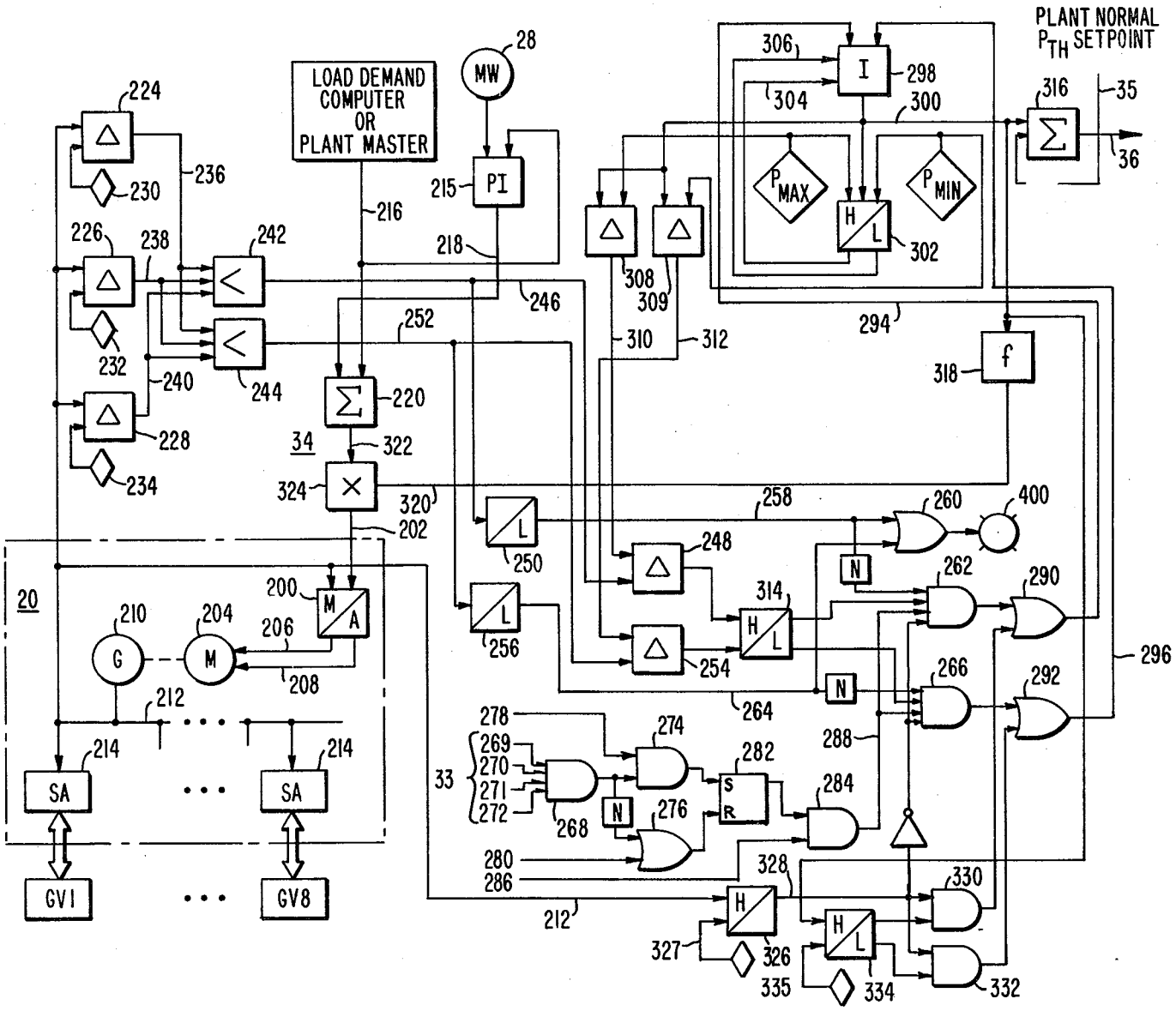
FIG. 10 is a functional block diagram schematic of an alternative embodiment of the invention suitable for use in the power plant depicted in FIG. 1.

In other power plant installations, the conventional turbine controls 20 (see FIG. 1) are embodied with analog electronics in lieu of a programmed digital computer. An alternate embodiment for use in these installations is shown in FIG. 10. Generally, these analog type turbine valve controllers comprise a conventional turbine master manual/automatic (M/A) stations 200 which normally receives a total steam flow demand signal 202 generated from either a load demand computer or a plant master unit (neither shown). In automatic mode, the M/A station 200 may control the operation of a conventional turbine load reference motor 204 utilizing a set of increase and decrease signals 206 and 208, respectively, in accordance with the value of the steam flow demand signal 202. In manual mode, the M/A station 200 permits an operator to manually operate the increase and decrease signals 206 and 208 using pushbuttons located on a control panel (not shown), for example. The load reference motor 204 may be mechanically coupled to drive an analog signal generating device 210, such as a motor driven potentiometer, to produce a signal 212 which is representative of the total steam flow reference from the turbine unit 16 (see FIG. 1). A conventional servo amplifier 214 may be coupled to each control valve GV1, . . . ,GV8 to control the positions thereof. The servo amplifiers 214 may be offset adjusted to provide a desired sequential valve control pattern and may be characterized by a predetermined set of gains which are automatically adjusted to yield the steam flow vs. valve position transformation required to control valve position in accordance with the desired sequential value control pattern. To correct for possible inaccuracies in the open loop characterization of the servo amplifiers 214, a megawatt feedback trim correction 215 is provided, in some cases, to compensate a turbine load demand signal 216 generated from a plant master or load demand computer unit, for example. The megawatt feed trim corrector 215 is normally a proportional plus integral controller having as inputs the turbine load demand signal 216 and an actual load signal as measured by the megawatt transducer 28. The trim corrector 215 generates a trim signal 218 which increases or decreases the plant load demand signal 216 utilizing a summer function 220.

In relation to this alternate embodiment, the efficient valve positioning unit 34 (see FIG. 1) comprises a plurality of deviation detectors of which three deviation detectors are shown at 224, 226, and 228 each having associated therewith a predetermined efficient valve position setting 230, 232 and 234, respectively, as one input. The total steam flow reference signal 212 is coupled to the other input of each of the deviations detectors 224, 226 and 228 and the respective output signals thereof 236, 238 and 240 are coupled to both a function 242 which determines the closest efficient valve point above a present value of the steam turbine flow reference signal 212 and a function 244 which determines the closest efficient valve point below the present value of the steam turbine flow signal 212. An output signal 246 of the function 242 is coupled as one input to a difference function 248 and to a comparator circuit 250 which is operative to detect that the valves are positioned at one of the predetermined efficient valve position settings. An output signal 252 of the function 244 is coupled as one input to another difference function 254 and to a comparator circuit 256 which is operative to detect that the control valves GV1, . . . ,GV8 are positioned at one of the predetermined efficient valve position settings. A digital output signal 258 provided from comparator circuit 250 is supplied to one input of an OR function 260 and an inverted state of the digital signal 258 is provided to one input of an AND function 262. Likewise, a digital output signal 264 from the comparator circuit 256 is supplied to the other input to the OR function 260 and an inverted state of the signal 264 is coupled to one input of an AND function 266.

Within the positioning unit 34 is included an arrangement of logical gating functions to determine a permissive operational status based on logical variables 33 indicating the status of the turbine controller 20. Digital inputs to an AND gate function 268 include the following:

(a) load feedback in service (269);

(b) MW controller in service (270);

(e) pressure not ramping (271); and (d) turbine control in auto mode (272). The output of gate 268 may be used as one input of an AND gate function 274 and in the inverted state used as one input of an OR gate function 276. The other input 278 to the AND gate function 274 may be applied from a pushbutton (operator set) generally located on an operator's control panel (not shown). Similarly, the other input 280 may be provided from another pushbutton (operator reset) which may also be located on an operator's control panel. The outputs of gates 274 and 276 provides the set and reset inputs of a conventional flip-flop 282, the output of which is connected to one input of an AND gate function 284. The other input 286 to the AND gate 284 may come from a plant load demand generator and is indicative of the status of load change in progress. The output signal 288 provides an in service permissive signal to another input of both AND gates 262 and 266.

During most of the steam flow range, the outputs of the AND gate functions 262 and 266 control the incrementing and decrementing of the boiler throttle pressure set point through OR gates 290 and 292 and over signal line outputs 294 and 296, respectively. The signals 294 and 296 are input to a pressure set point adjuster 298 which in the preferred embodiment may be an integrating type function with a selectable rate. A pressure set point adjustment signal 300 from the adjuster 298 is supplied to a window comparator function 302 and compared with predetermined maximum and minimum pressure set point values, $P_{MAX}$ and $P_{MIN}$, respectively. Signals 304 and 306 are indicative of maximum and minimum limiting conditions and are provided to the adjuster 298 to prohibit further adjustment of the boiler throttle pressure set point. The maximum $P_{MAX}$ and minimum $P_{MIN}$ set point values are additionally provided to one input of the difference functions 308 and 309, respectively. The other input to the difference functions 308 and 309 is the generated pressure set point 300. The output signals 310 and 312 of the difference functions 308 and 309 correspond to the amount of pressure set point signal remaining before the maximum or minimum limiting conditions are reached. These signals 310 and 312 are coupled to the other input to the difference functions 248 and 254, respectively. A window comparator 314 with adjustable deadband ranges receives the outputs from the difference functions 248 and 254 and decides if a pressure set point increment or decrement is required by either setting a signal to one input of gate 262 true or setting a signal to one input of gate 266 true, respectively.

In this alternative embodiment, a predetermined plant normal boiler throttle set point value is provided to one input of a summator 316 from a signal line designated by 35. The pressure set point adjustment value 300 derived from the adjuster 298 is added to the plant normal pressure set point 35 in the summer 316 to generate a composite boiler throttle pressure set point 36 which is supplied to the conventional boiler control system 30 as shown in FIG. 1. In addition, the set point adjustment value 300 is operated on by a function at 318 which may be comprised of at least one gain and may include phase compensation as related to the plant dynamics. The functional circuit 318 yields a signal 320 which is used to preferably multiply (324) the compensated plant load demand signal 322 to yield a turbine steam flow demand signal 202 which is corrected for the deviation 300 in pressure at point 36 from the predetermined plant normal pressure set point 35.

In addition to the above described structure, the alternative embodiment additionally includes a full load detector function comprising a comparator function 326 which compares the total steam flow reference signal 212 with a predetermined threshold value 327, say 95%, for example. The comparator output signal 328 is supplied to one input of a set of AND gate functions 330 and 332 and an inverted signal 328 is provided as the fourth input to the AND gate functions 262 and 266. The second inputs of the AND gates 330 and 332 are derived from a window comparator function 334 which compares the boiler pressure adjustment set point signal 300 with another predetermined value 335, preferably close to 0%. The outputs of the AND gates 330 and 332 are supplied to the other inputs of the OR gate functions 290 and 292, respectively.

In describing the operation of this alternative embodiment, it is assumed that a plant operating point initially exists which suggests a total steam reference value 212 which is not at one of the at least three efficient valve point settings 230, 232 and 234. The deviation detectors 224, 226 and 228, which may be conventional differential amplifier configurations, compute the differences between the present value of total steam reference 212, which is representative of the present valve point setting, and each of the efficient valve point settings. These calculated differences 236, 238 and 240 may be scaled in such a manner as to be representative of the pressure set point adjustments required to move the valves to the correspondingly associated efficient valve set point setting. The smallest amplitude of the positive difference signals, which may be indicative of the adjustment in boiler throttle pressure set point required to reach the closest efficient valve point above the present valve point setting, is selected using function 242 and the smallest amplitude of the negative difference signals, which may be indicative of the adjustment in throttle pressure set point required to reach the closest efficient valve point below the present valve point setting, is selected by function 244. Functions 242 and 244 may be commonly implemented with an arrangement of limiters, absolute and low-select circuits which are of a conventional design. The smallest positive difference amplitude (246) is subtracted in 248 from the signal 310 which is representative of the amount of adjustment pressure set point increase allowed before reaching the preset max. limit $P_{MAX}$. The smallest negative difference amplitude (252) is subtracted in 254 from the signal 312 which is representative of the amount of adjustment pressure set point decrease allowed before reaching the preset minimum limit $P_{MIN}$. The window comparator 314 determines which of the two difference circuits 248 and 254 has computed the smaller positive amplitude and enables the correspondingly associated AND gate 262 or 266 to increase or decrease the pressure set point adjustment signal 300 accordingly. For example, if the status of operation exists that an in service operation is permitted (288) and a valve efficient point has not been reached (258 and 264) and the steam flow reference signal is not close to full load, then when the output signal of the difference function 248 has a smaller positive amplitude than the output signal of the difference function 254, a request to increase the pressure set point adjustment 300 is conducted through AND gate 262, OR gate 290 and over signal line 294 to the integrating function 298. Likewise, if the output of 254 has the smaller positive difference, the comparator 314 requests a decrease in the pressure set point adjustment signal 300 conducted through AND gate 266, OR gate 292 and over signal line 296 assuming the same permissive status conditions exist as described above.

The difference functions 248 and 254 essentially compares the amount of pressure set point adjustment remaining for an allowable pressure set point state against the amount required to achieve the closest predetermined efficient valv point setting and allows a pressure set point adjustment for reaching the closest efficient valve point setting to occur if that adjustment is within allowable limits (positive signal amplitude). If both pressure set point adjustments are allowable as may be indicated by positive amplitude signals resulting from both difference functions 248 and 254, then window comparator 314 selects the lowest positive amplitude signal to determine the direction in which to adjust the pressure set point. Otherwise, the window comparator 314 only accepts the positive amplitude signal and directs the adjustment of the pressure set point accordingly.

The pressure set point adjuster 298 modifies the set point adjustment signal 300 as directed by the increment and decrement status of the signal lines 294 and 296, respectively. The change in the signal 300 is reflected in the composite throttle pressure set point 36 which directs the boiler controls 30 to alter the firing conditions of the boiler 14 to converge the boiler pressure $P_{TH}$ as measured by transducer 32 to the set point 36 (see FIGS. 1 and 4). In addition, the change in the set point adjustment signal 300 which is representative of the deviation of the plant normal pressure set point 35 governs the modulation of the compensated load demand signal 322 in accordance with the function designated at 318 and the multiplication performed at 324 to compare the new position settings for the turbine control valves required to achieve efficient valve point setting. It appears that this feedforward type control does not rely on an interaction in the boiler-turbine-generator process to cause movement of the control valves and for this reason, it is believed that it minimizes process errors in the megawatt generation and the need to disrupt the boiler 14 by temporarily over or underfiring the fuel for purposes of changing its stored energy. In this preferred embodiment, then, the multiplier 324 operates to change the proportionality relationship between the compensated plant load demand signal 322 and the reference signal 212 in accordance with a deviation in pressure set point from the normal plant pressure set point 35. As an example of this control operation, suppose the gain of the multiplier 324 is set at one for the case in which there is no pressure set point deviation 300 from the normal plant pressure set point 35, now as the pressure set point 36 is adjusted above normal, the gain as characterized by multiplier 324 is decreased based on the signal 320 representative of the function of the deviation of the pressure set point above the normal plant set point. Therefore, as the pressure set point is adjusted to increase as described hereinabove, the total steam flow demand 202 and correspondingly the reference signal 212 are corrected concurrently therewith to cause the turbine control valves GV1, . . . ,GV8 to close a proportional amount in a direction towards the selected efficient valve point setting.

As the control valves are positioned by the steam flow reference signal 212 at an efficient valve point setting, the comparators 250 and 256 detect substantially zero difference signals at 246 and 252, respectively. The output signals 258 and 264 of the comparators are indicative of the valves being positioned at an efficient valve point setting and may affect the output of the OR gate 260 to light a lamp 400 which may be disposed on the operator's control panel to provide the plant operator with this valve status. In addition, the inverted signals 258 and 264 disable AND gates 262 and 266 from supplying increase and decrease adjustment signals to the pressure set point adjuster 298. The pressure set point adjustment 300 remains at its present value until another desired load change is enacted resulting in repositioning the control valves outside of an efficient valve point setting.

This alternative embodiment has the additional feature of disabling the efficient valve point positioning control as the turbine steam flow reference 212 attains a value substantially close to 100% which is an indication that all of the control valves are near a wide open state. More specifically, the reference signal 212 is compared with the predetermined set point 327 in comparator 326. As the reference signal 212 becomes greater than the set point 327, the signal 328 enables AND gates 330 and 332 and disables AND gates 262 and 266. In this state, the adjustment of the throttle pressure set point is controlled by the window comparator 334 rather than the window comparator 314. The pressure set point 36 is adjusted toward the plant normal pressure set point 35 by reducing the pressure set point adjustment signal 300 to substantially zero (i.e. set point 335). Therefore, as the control valves are positioned substantially close to a wide open condition, the boiler throttle pressure is controlled to the plant normal operating state to optimize overall plant performance.

While the functional block schematic diagram of FIG. 10 has been described in connection with electronic hardware such as amplifiers, limiters, absolute and low limit select and logic circuits, it is understood that these functions may be performed equally as well in a programmed microprocessor or a combination of both.

We claim:

1. In a power plant that generates electrical energy including a steam producing boiler having a boiler throttle pressure associated therewith; a steam turbine having a plurality of steam admission valves for regulating the amount of boiler produced steam conducted therethrough; and an electrical generator driven by said steam turbine to generate electrical energy, a system for minimizing power plant energy losses substantially caused by steam flow valve throttling while maintaining said power plant at a desired power generation level, said system comprising:

means for rendering the valve positions of said plurality of steam admission valves to a selected state of a plurality of predetermined steam admission valve position states by adjusting the value of said boiler throttle pressure as a function of said selected state, said each predetermined state substantially corresponding to a minimum of valve throttling losses.

2. A system in accordance with claim 1 wherein the steam admission valves are organized to regulate steam flow in predetermined valve groupings operative according to sequential pattern based on the predetermined steam admission valve position states.

3. A system in accordance with claim 1 wherein the selection of one of the plurality of predetermined steam admission valve position states is based on a function of a present value of the boiler throttle pressure, predetermined upper and lower limiting values of the boiler throttle pressure, the valve position values corresponding to a present state of the plurality of steam admission valves which is other than one of the predetermined states, the predetermined steam admission valve position states and the present value of steam flow corresponding to the desired power generation level.

4. A system in accordance with claim 3 wherein the selection function calculates a first pressure adjustment adequate to render the positions of the steam admission valves in a first closest of the predetermined valve position states which offers a greater calculated virtual flow with respect to the present value of steam flow, and a second pressure adjustment adequate to render the positions of the steam admission valves in a second closest of the predetermined valve position states which offers a lower calculated virtual flow with respect to the present value of steam flow; and wherein one of said first and second closest states offers a calculated virtual steam flow closer in value to the present steam flow value than the other, said one closest state being the selected state if the pressure adjustment associated therewith is within the predetermined upper and lower limiting values, said other closest state being the selected state otherwise.

5. A system in accordance with claim 4 wherein the present value of boiler throttle pressures is adjusted in the direction of the one of the first and second pressure adjustment values which corresponds to the selected closest valve position state at a desired rate with respect to time until the positions of the steam admission valves are rendered to the selected closest valve position state.

6. A system in accordance with claim 4 wherein the steam admission valves are organized to regulate flow in predetermined valve groupings operative according to a sequential pattern based on the predetermined steam admission valve position states; and wherein the first and second closest predetermined valve position states are determined in relation to said valve grouping sequential pattern of operation.

7. In a power plant that generates electrical energy at a desired power generation level including a steam producing boiler having a boiler throttle pressure associated therewith; a steam turbine having a plurality of steam admission valves for regulating the amount of boiler produced steam conducted therethrough; and an electrical generator driven by said steam turbine to generate electrical energy at said desired power level, a system for minimizing the power plant energy losses substantially caused by steam flow throttling across partially opened steam admission valves, said system comprising:

means for selecting one of a plurality of predetermined steam admission valve position states which substantially correspond to minimizing valve throttling losses;

first means governed by said selected predetermined steam admission valve position state to adjust the boiler throttle pressure of said steam boiler; and second means responsive to said adjustment of boiler throttle pressure to position said plurality of steam admission valves to selected state by maintaining the generated energy substantially at the desired power generation level.

8. A system in accordance with claim 7 wherein the selecting means is operative to calculate a first and a second virtual steam flow value respectively corresponding to a first and a second predetermined valve position state; and wherein one of the first and second predetermined valve position states is selected by the selecting means based on a relationship between said calculated first and second virtual steam flow values and a present value of steam flow corresponding to the desired power generation level.

9. A system in accordance to claim 8 wherein the one of the first and second predetermined valve position states which corresponds to the first and second calculated virtual steam flow value that is closer to the present steam flow value becomes the selected valve position state if the pressure adjustment sufficient to position the valves to the selected state does not exceed predetermined pressure limitations, said other of the first and second predetermined valve position states becoming the selected state otherwise.

10. A system in accordance to claim 8 wherein the first and second virtual flow values are repsectively above and below the present value of steam flow.

11. A system in accordance with claim 8 wherein the second means positions the valves in predetermined valve groupings in a sequential pattern based on the plurality of predetermined steam admission valve position states; wherein a present valve position state is a state other than one of the plurality of predetermined valve position states; and wherein the first predetermined valve position state is that closest of the plurality of predetermined valve position states to the present valve position state according to the sequential valve grouping positioning pattern having its correspondingly calculated virtual steam flow value above the present steam flow value and the second predetermined valve position state is the closest of the plurality of predetermined valve position states to the present valve position state according to the sequential valve grouping positioning pattern having its correspondingly calculated virtual steam flow value below the present steam flow value.

12. A system in accordance to claim 11 wherein the one of the first and second predetermined valve position states which corresponds to the first and second calculated virtual steam flow value that is closer to the present steam flow value becomes the selected valve position state if the pressure adjustment sufficient to position the valves to the selected state does not exceed predetermined pressure limitations, said other of the first and second predetermined valve position states becoming the selected state otherwise.

13. A system in accordance with claim 12 wherein the boiler throttle pressure is adjusted by the first means in a direction to cause the second means to position the plurality of steam admission valves to the selected state, said throttle pressure being adjusted at a desired rate with respect to time until the positions of the plurality of steam admission valves are rendered to the selected state.

14. A system in accordance with claim 13 wherein the function of the selecting means, first means and second means are substantially carried out in a programmed digital computer based structure.

15. A system in accordance with claim 14 wherein the calculations of said virtual flow values are performed by a valve management program which resides in said programmed digital computer and may be called for execution upon request according to the programming thereof.

16. A system in accordance with claim 14 wherein the valve position states which correspond to minimizing valve throttling losses are predetermined by an optimum valve position program which resides in said programmed digital computer and may be called for execution upon request according to the programming thereof.

17. A system in accordance with claim 7 wherein the first means includes:

means for generating a first signal representative of a pressure set point;

means for generating a second signal representative of the actual boiler throttle pressure;

a pressure set point controller governed by said first and second signals to modify the boiler operational conditions such that the difference between said first and second signals is reduced to substantially zero; and means for adjusting said first signal at a desired rate and in a direction to cause the plurality of steam admission valves to be positioned to the selected state.

18. A system in accordance with claim 7 wherein the second means includes:

means for generating a first signal representative of the desired power generation level;

means for generating a second signal representative of the actual power generation, said actual power generation being influenced by the adjustment of boiler throttle pressure; and means for positioning the steam admission valves according to a predetermined valve grouping sequential positioning pattern to converge said second signal to said first signal, whereby the steam admission valves are positioned to the selected state in response to a deviation of the actual power generation from the desired power generation as caused by the adjustment of boiler throttle pressure.

* * * * *